US005427283A

United States Patent [19]

Whittaker et al.

[11] Patent Number: 5,427,283

[45] Date of Patent: Jun. 27, 1995

[54] DISPENSER FOR POWDER OR GRANULAR MATERIAL

[75] Inventors: Richard E. Whittaker; Robert Back; Eric S. Daytner, all of New Castle, Pa.

[73] Assignee: R. E. Whittaker Company, New Castle, Pa.

[21] Appl. No.: 139,417

[22] Filed: Oct. 20, 1993

[51] Int. Cl.[6] ..... G01F 11/20

[52] U.S. Cl. ..... 222/414; 222/565; 222/626

[58] Field of Search ..... 239/114, 142, 650, 689; 316/195-196; 222/216, 217, 345, 347, 148, 330, 414, 565, 342, 610, 626, 623, 485

[56] References Cited

U.S. PATENT DOCUMENTS

| | | | |
|---|---|---|---|
| 473,952 | 5/1892 | Ozley | 222/623 |
| 970,224 | 9/1910 | Hoelzer | 222/414 |
| 2,622,341 | 12/1952 | Finnegan | 222/345 |
| 2,692,705 | 10/1954 | Marihart | 222/565 |
| 2,839,222 | 6/1958 | Thelander | 222/610 |
| 3,080,098 | 3/1963 | Fierman | 222/623 |
| 3,432,884 | 3/1969 | Lysgkowski et al. | 222/414 |
| 3,776,430 | 12/1973 | Grandrud | 222/485 |
| 4,137,601 | 2/1979 | Eschenbach | 15/380 |
| 4,240,569 | 12/1990 | Bessinger | 222/220 |
| 4,268,935 | 5/1981 | Bessinger | 15/320 |
| 4,486,126 | 12/1984 | Hellerman | 222/345 |

FOREIGN PATENT DOCUMENTS

| | | | |
|---|---|---|---|
| 1278160 | 9/1968 | Germany | 222/330 |

*Primary Examiner*—Andres Kashnikow
*Assistant Examiner*—Philippe Derakshani
*Attorney, Agent, or Firm*—Titus & McConomy

[57] ABSTRACT

A dispenser for powder or granular material which has a hopper for containing the material to be dispensed. The hopper includes an arcuate bottom member having a plurality of discharge openings. A wiper is positioned along the length of the bottom member and mounted to a rotatable shaft. The wiper includes a plurality of wiper elements mounted to the shaft each having at least one radially extending blade. The radial extent of each blade is sufficient to contact the openings during rotation of the shaft. Adjacent blades are mounted so as to be offset from each other. A drive is provided to rotate the shaft.

10 Claims, 3 Drawing Sheets

DISPENSER FOR POWDER OR GRANULAR MATERIAL

FIELD OF THE INVENTION

The present invention relates to a compound dispenser for spreading various types of powder or small granular materials, and, in particular, to a self-powered dispenser for carpet cleaning devices such as cleaning and scrubbing machines.

BACKGROUND OF THE INVENTION

Dispensers and spreaders for spreading various types of material are generally well known. Powder and granular materials are typically amiable to this method of dispension. It is also well known to use powders for cleaning carpets. Various cleaning machines and scrubbers have been proposed. See for example, U.S. Pat. Nos. 4,137,601 and 4,240,569. Also, specialized dispensers have been proposed for attachment to scrubbers and cleaners to uniformly spread and dispense cleaning powders.

Notwithstanding the various proposals for such dispensers, both internal and external to the scrubbers, those commercially available have been unsuccessful. The prevalent method for dispensing powders is by hand broadcasting a cleaning powder in front of the scrubber or cleaning machine. This operation requires two people—one broadcasting the cleaner and the other operating the machine. In the manual operation, the dispensing of the powder is typically inconsistent in amount and nonuniform in coverage.

Accordingly, it is an object of the present invention to provide a self-powered powder dispensing device which is adaptable to fit on cleaning units to dispense a uniform amount of cleaning powder. It is a further object of the invention to provide a dispensing device which dispenses of the powder in a uniform and consistent manner and without caking of the powder or clogging of the discharge openings. It is also an object of the invention to provide a dispensing device which is economical to produce and easy to maintain.

SUMMARY OF THE INVENTION

Generally, the dispenser of the present invention comprises a hopper with a substantially arcuate bottom member. The hopper is preferably fabricated out of plastic material such as ABS plastics. The hopper preferably includes a lid with a window to view the contents of the hopper.

A bottom member, preferably arcuate in configuration, is provided with a plurality of openings which extend therethrough. In a presently preferred embodiment of the invention, 188 equally spaced beveled openings are provided across the length of the bottom member, preferably in five offset rows.

Positioned for rotation within the hopper adjacent to the bottom member is a wiper. The wiper comprises a shaft extending substantially the length of the bottom member. Mounted on said shaft are a plurality of radial wiper elements, each wiper element is composed of at least one radially extending blade. Each blade is preferably offset from an adjacent blade of the next adjacent wiper element. In a preferred embodiment, this offset is 45°. The blades are of radial dimension to wipingly contact a substantial portion of the arcuate bottom member within the associated longitudinal extent of the blade. In particular, each blade is designed to wipe across that portion of the arcuate bottom member through which the openings are located, thusly forcing the powder out through the openings.

A drive is mounted to the hopper and connected to the shaft for rotation thereof. In a preferred embodiment, the drive is connected to the shaft through a gear reducer and cogged belt drive. However, other means, such as a direct drive, are available to rotate the wiper.

The dispenser of the present invention is self-contained and is, therefore, advantageously used to retrofit existing scrubber and carpet cleaning machines. In such cases, attachment connectors are located on the hopper and designed to attach the dispenser to the front of the cleaning machine. Additionally, the dispenser of the invention can be built as an integral part of the cleaning machine. Other advantages of the invention will become apparent from a perusal of the following detailed description of a presently preferred embodiment of the invention taken in connection with the accompanying drawings.

PRESENTLY PREFERRED EMBODIMENTS

Figure 1:
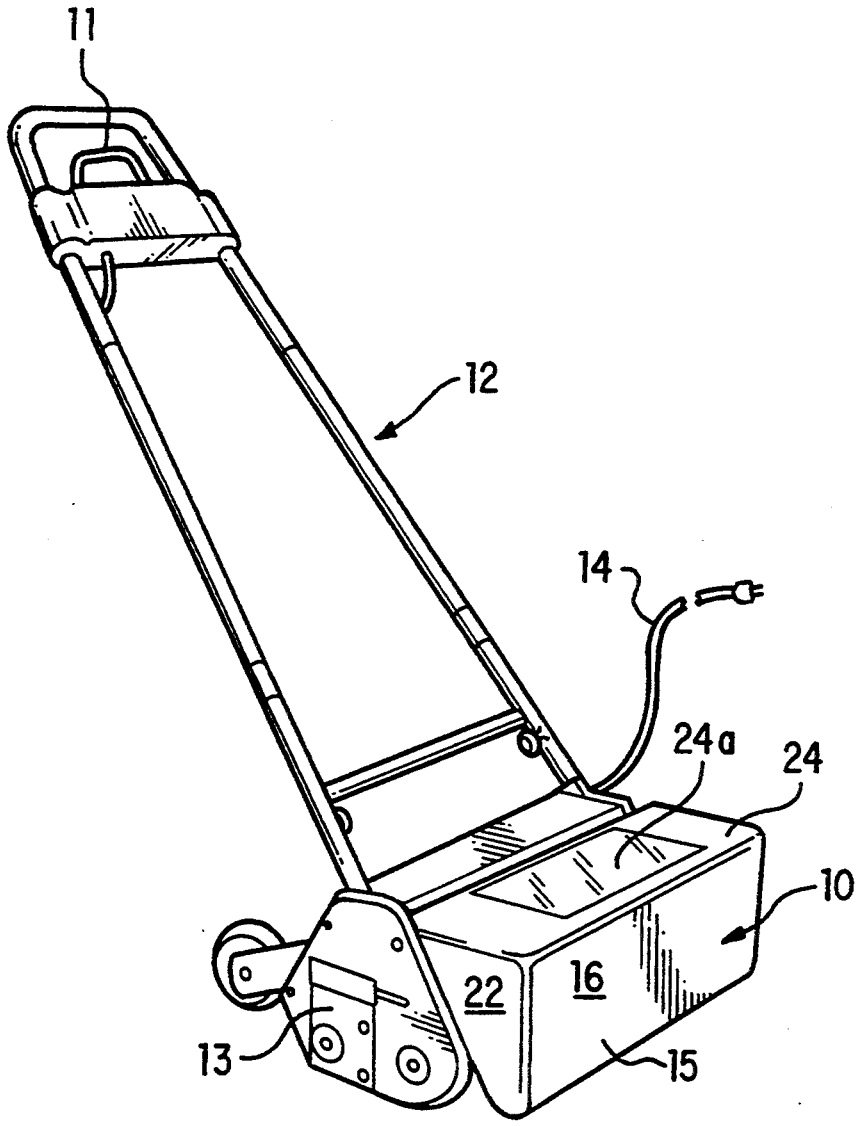
FIG. 1 is a perspective view of a carpet cleaner on which is mounted the dispenser of the present invention.

Referring to FIG. 1, the presently preferred embodiment of dispenser 10 of the present invention is shown and described with respect to a carpet cleaning machine 12. Notwithstanding the functioned description of the presently preferred embodiment relating to carpet cleaning devices, it is applicable to other dispensing applications. The operations of carpet cleaning devices are described in, e.g., U.S. Pat. Nos. 4,137,601, 4,240,569, and 4,268,935. In general, however, the carpet is cleaned by typically two counter rotating cylindrical brushes which rotate at about 480 rpm. These brushes apply approximately 2.5 pounds of pressure per square inch of contact surface.

The extreme density of commercially available brushes is used to carry dispersed carpet cleaning powder deep into the carpet piles to vibrate and agitate the powder against the individual fiber strands. The rotation of the brushes provides both a mechanical cleaning and a grooming of the carpet by lifting the pile. The counter rotating brushes are mounted in housing 13 of cleaner 12. In order for proper cleaning, the cleaner powder contained in hopper 15 of dispenser 10 must be dispersed in a consistent and uniform manner. As shown in FIG. 1, hopper 15 is mounted on cleaner 12 just in front of housing 13 to uniformly dispense the powder immediately ahead of the rotating brushes. The electric drive motor 40 is actuated through a momentary-on switch pull ring 11 located on the handle 12 of the scrubber or cleaning machine 13 and connected to the dispenser 10 by a two prong power cord 14.

Figure 2:
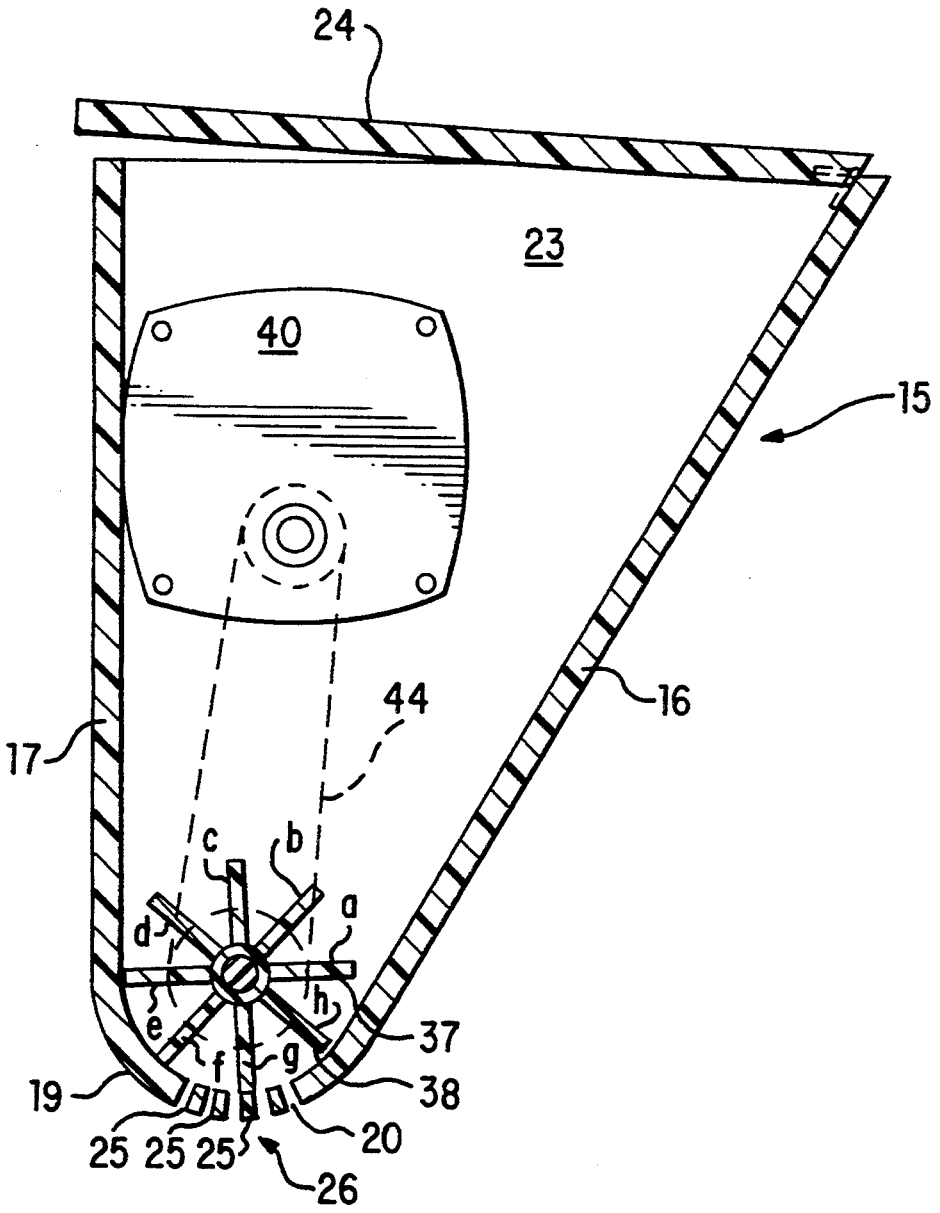
FIG. 2 is a transverse cross sectional view of the hopper of FIG. 1.
Figure 3:
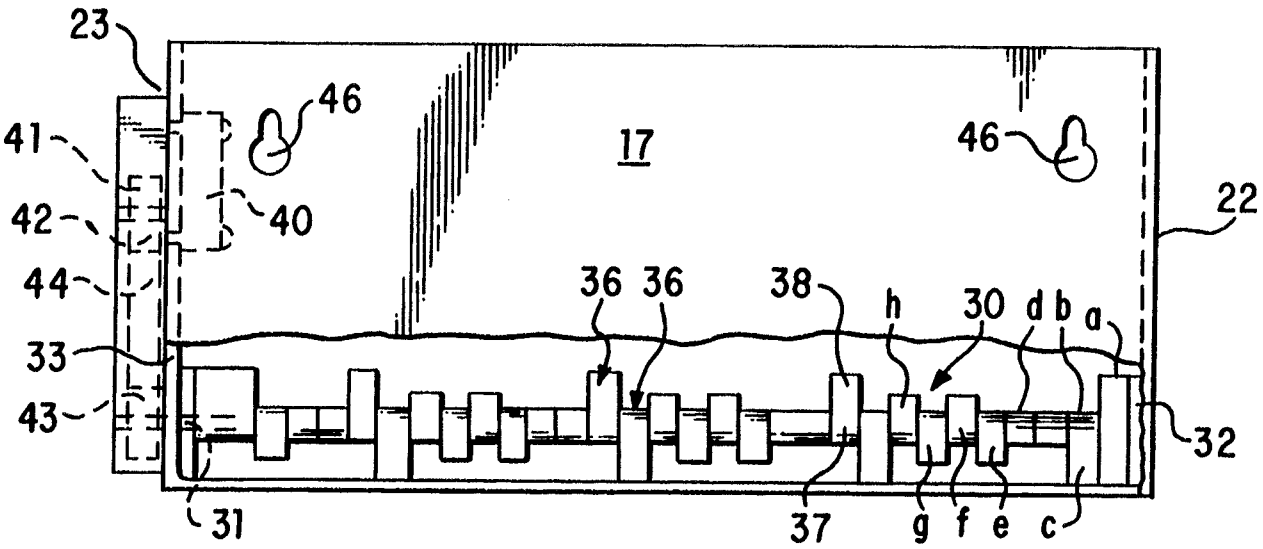
FIG. 3 is an elevation of the back of the dispenser in a partial breakaway.

Referring to FIGS. 2 and 3, dispenser 10 comprises a hopper 15 having longitudinal front and back walls 16 and 17, respectively. Front and back walls 16 and 17 generally converge to bottom 19 which has a substantially arcuate bottom portion or member 20. Hopper 15 also includes a pair of substantially triangular end walls 22 and 23. In the preferred embodiment, hopper 15 is constructed as a unitized member from ABS plastic. An operable lid 24 is preferably hinged to a hopper and includes a viewing window 24*a*.

Figure 4:
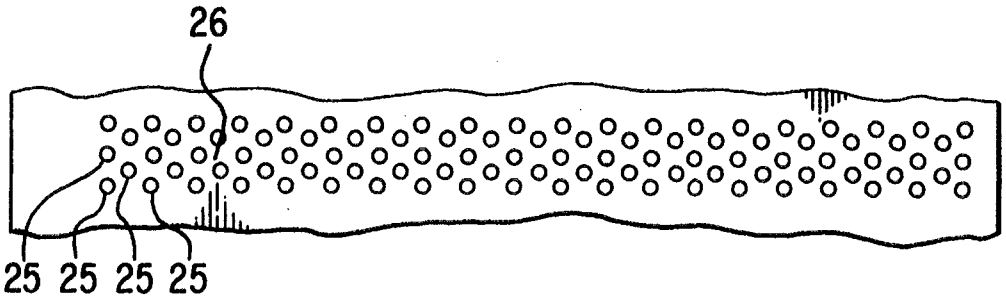
FIG. 4 is a breakaway top plan view of the bottom member.

As shown more clearly in FIG. 4, bottom member 20 includes a plurality of openings 25. Openings 25 extend across the length of bottom member 20 and are preferably aligned in five rows, the center row being along the apex 26 of the arcuate members. Openings 25 are preferably beveled and equally spaced from each other. The diameter of the opening at the discharge end is about three-sixteenth of an inch. In the preferred embodiment, 188 openings are provided in bottom member 20.

Mounted within hopper 15 is wiper 30. Wiper 30 comprises a shaft 31, rotatably mounted in bushing 32 and 33 secured to end walls 22 and 23, respectively. Bushing 32 and 33 may be made of stainless steel or bronze.

Shaft 31 is preferably made from stainless steel. Mounted on shaft 31 are a plurality of wiper elements 36. Each wiper element 36 comprises a cylindrical body 37 adapted to engagingly fit over shaft 31 and a radially extending blade 38. The length of blade 38 is substantially the same as the radius of bottom member 20 so as to effect contact between the blade and the inner radius of the bottom member 20, especially within the area of apex 26.

Preferably, each wiper element 36 is extruded from neoprene and has a durometer of 90±5. In the preferred embodiment shown in FIG. 3, wiper 30 comprises thirty wiper elements 36. Each adjacent wiper element is mounted to shaft 31 with an adhesive, such as a cyanoacrylate ester glue, offset at an angle of about 45°. As shown in FIG. 2, wiper blades 38*a–h* are each offset 45° from the adjacent blade.

An electric motor 40 is mounted inside hopper 15 to end wall 23, but may be externally mounted or directly mounted to shaft 31. In this embodiment, however, it is desirable to use a gear reducer 41 to increase the torque available to drive wiper 30. In this embodiment, a Hurst gear motor has been found advantageous and provides a 3 to 1 speed reduction. The output of reducer 41 is connected to toothed pulley 42 to drive shaft 31 through preferably a toothed pulley 43 by means of cogged belt 44.

Attachment means 46 are provided on back 17 of hopper 15 to attach it to cleaner 12. Other attachment means can be provided to accommodate the particular configuration of cleaner. It is necessary, however, that the bottom portion 20 of hopper 15 be positioned ahead of the cleaner's brush housing and this may require that the attachment means provide a stand-away device to achieve the desired positioning.

While presently preferred embodiments of the invention have been shown and described, it may be otherwise embodied within the scope of the appended claims.

What is claimed is:

1. A dispenser for powder or granular material comprising:

a. a hopper for containing powder or granular material having a bottom member of substantially arcuate configuration, said bottom member including a plurality of openings therethrough and throughout the length thereof;

b. a wiper extending substantially the length of said bottom member, said wiper comprising a rotatable shaft having mounted thereon a plurality of contiguous wiper elements, each wiper including at least one blade having a length sufficient for contacting the bottom member at said openings and offset from a contiguous wiper blade; and c. a drive for rotating said shaft.

2. A dispenser as set forth in claim 1 wherein said openings are equally spaced from each other.

3. A dispenser as set forth in claim 2 wherein said plurality of openings are positioned along at least three rows.

4. A dispenser as set forth in claim 1, 2, or 3 wherein each wiper blade is offset from an adjacent blade.

5. A dispenser as set forth in claim 4 wherein said offset is about 45 degrees.

6. A dispenser as set forth in claim 1 wherein said wiper element is semi-rigid.

7. A dispenser as set forth in claim 1 wherein said wiper element is made of neoprene and has a durometer of 85 to 95.

8. A dispenser as set forth in claims 1 wherein said drive includes a motor, a gear reducer connected to an output of said motor, a first pulley connected to an output of said gear reducer, a second pulley connected to said shaft and a belt connecting said first and second pulley.

9. A dispenser as set forth in claim 8 wherein said first and second pulley is cogged and said belt is a cogged pulley belt.

10. A dispenser as set forth in claim 8 wherein said drive includes a hand operated pull ring and power source for operating said motor.

* * * * *